US005185943A

United States Patent [19]

Tong et al.

[11] Patent Number: 5,185,943

[45] Date of Patent: Feb. 16, 1993

[54] ATHLETIC SHOE HAVING AN INSERT MEMBER IN THE OUTSOLE

[75] Inventors: James K. Tong, Beaverton; Lawrence Selbiger; Jerry D. Stubblefield, both of Portland, all of Oreg.; Jack Curley, Dunstable, Mass.

[73] Assignee: Avia Group International, Inc., Portland, Oreg.

[21] Appl. No.: 762,265

[22] Filed: Sep. 20, 1991

Related U.S. Application Data

[63] Continuation of Ser. No. 226,058, Jul. 29, 1988, abandoned.

[51] Int. Cl.[5] ..... A43B 13/18

[52] U.S. Cl. ..... 36/28; 36/27; 36/37; 36/35 R

[58] Field of Search ..... 36/114, 30 R, 32 R, 36/107, 108, 59 R, 30 A, 37, 38, 28, 27, 35 R

[56] References Cited

U.S. PATENT DOCUMENTS

| | | | |
|---|---|---|---|
| Re. 32,698 | 6/1988 | Brown | 36/44 |
| 495,373 | 4/1893 | Roche . | |
| 653,161 | 7/1900 | Wolf | 36/14 |
| 1,387,411 | 8/1921 | Kolkebeck . | |
| 1,923,365 | 8/1933 | Gaines | 36/107 X |
| 2,918,733 | 12/1959 | Anderson | 36/67 D |
| 3,101,763 | 8/1963 | McGehee | 36/67 D |
| 3,142,910 | 8/1964 | Levine . | |
| 3,204,347 | 9/1965 | Snow | 36/107 |
| 3,577,503 | 5/1971 | Innocenti . | |
| 3,852,895 | 12/1974 | Funck . | |
| 4,335,530 | 6/1982 | Stubblefield | 36/30 R |
| 4,372,058 | 2/1983 | Stubblefield | 36/114 X |
| 4,481,726 | 11/1984 | Phillips | 36/30 R |
| 4,506,460 | 3/1985 | Rudy | 36/38 X |
| 4,542,598 | 9/1985 | Misevich et al. | 36/114 |
| 4,561,195 | 12/1985 | Onoda et al. | 36/30 R |
| 4,598,487 | 7/1986 | Misevich | 36/114 |
| 4,614,046 | 9/1986 | Dassler | 36/30 R |
| 4,624,061 | 11/1986 | Wezel et al. | 36/30 A |
| 4,815,221 | 3/1989 | Diaz | 36/37 X |
| 4,854,057 | 8/1989 | Misevich et al. | 36/114 |

FOREIGN PATENT DOCUMENTS

| | | | |
|---|---|---|---|
| 481026 | 8/1916 | France | 36/30 R |
| 958766 | 12/1947 | France . | |
| 55-55817 | 4/1980 | Japan . | |
| 1081988 | 9/1967 | United Kingdom | 36/37 |
| 1378461 | 12/1974 | United Kingdom | 36/67 D |
| 1404456 | 8/1975 | United Kingdom | 36/59 R |
| 2114869 | 9/1983 | United Kingdom | 36/114 |

OTHER PUBLICATIONS

Cavanagh, Peter R.; The Running Shoe Book; CA, Anderson World, Inc., 1980 p. 184, FIG. 8.12.

*Primary Examiner*—Paul T. Sewell
*Assistant Examiner*—Thomas P. Hilliard
*Attorney, Agent, or Firm*—Sterne, Kessler, Goldstein & Fox

[57] ABSTRACT

The present invention relates to an insert member for use within the sole region of an athletic shoe. The insert member is made from a resilient material and provides improved energy return to the outsole to enhance recovery from the forces applied to the shoe.

30 Claims, 11 Drawing Sheets

ATHLETIC SHOE HAVING AN INSERT MEMBER IN THE OUTSOLE

This application is a continuation of application Ser. No. 07/226,058, filed Jul. 29, 1988, now abandoned.

BACKGROUND OF THE INVENTION

1. Field of the Invention

This invention relates generally to athletic shoes, and more particularly to an apparatus and method for providing increased durability, stability and rebound in athletic shoes.

2. Description of Related Art

A recent surge to provide footwear which is both comfortable and anatomically beneficial has resulted in a plethora of ideas having varying degrees of effectiveness. Most of these ideas are merely variations of ideas which have been around for years. Historically, there have been a number of attempts to increase the cushioning and control of an athletic shoe by making modifications to the midsole, which is that material which generally lies above the outsole. The development of the midsole has led to shoes which take into account the physiology of the foot. The numerous attempts to provide superior cushioning in athletic shoes have led to three broad categories of developments, two of which involve the midsole directly.

The first broad category utilizes different materials and configurations of the midsole to improve cushioning as well as provide effective foot control. For example, materials of different hardnesses may be used to provide cushioning and foot control, or a variety of devices may be encapsulated in a midsole to increase cushioning. This type of show has the disadvantage of a short life due to breakdown of the materials used to form the midsole. Since many shoes use only ethyl vinyl acetate EVA or polyurethane (PU) for cushioning, the cells of these foams have a tendency to break down and thus diminish the usefulness of the shoe.

The second category of device utilizes pneumatic devices within the midsole. An example of this is taught in U.S. Pat. No. 545,705, issued to McDonald. The McDonald device is an elastic air filled cushioning device which is incorporated into the heel of a shoe to provide cushioning. A similar device is taught in U.S. Pat. No. 1,498,838 to Harrison Jr. which uses a number of tubes which lie within the midsole. These tubes are inflated by a valve to maintain a pressure above ambient. The tubes in the Harrison Jr. device are made of a flexible inelastic material.

The disadvantages of encapsulating gas within the midsole of a shoe are numerous. It is exceedingly difficult and costly to encapsulate gas in a material. It is much easier, for example, to cut a piece of conventional midsole material such as ethyl vinyl acetate (EVA) to a desired specification than to make a container which retains pressurized air or other gas. The problem of diffusion of gas from a container can be somewhat decreased by using large molecule gases as the encapsulated gas. Using such a gas is expensive and as such increases the expense of manufacturing such a shoe.

Material puncture is also a problem with pressurized gas midsoles. Again, while this problem might be somewhat diminished by careful material selection, the problem of puncture nevertheless exists and the solution to such a problem can add additional manufacturing expense. Yet another serious drawback with this type of shoe is that the pressure of the gas within the encapsulating container is temperature dependent. As such, the stiffness of the shoe varies as the shoe warms up. Similarly, the shoe may respond differently in cold and warm temperatures. Along these same lines, the midsoles are altitude dependent, which means that the shoe will have different support characteristics depending on what altitude it is used at.

Rear foot control and stability is another problem with shoes which encapsulate gas within the midsole. In simple terms, encapsulated gas midsoles are oftentimes too mushy to give proper support.

In light of the multitude of problems associated with gas-encapsulated midsoles, it is of great importance to find alternatives which provide both adequate cushioning, stability and support. Such alternatives must be economical and must eliminate the problems of encapsulated tube technology without sacrificing cushioning.

The third broad category of devices which are intended to increase the cushioning of a shoe include devices which modify an outsole. An outsole is typically made of material such as rubber, polyurethane (PU), thermoplastic rubber (e.g., EVA) and the like. These materials are chosen for outsoles because they are wear resistant. Typically, these materials have fairly good memory characteristics. That is, if the outsole material is deformed either by compression or bending forces, it tends to return to its original shape. The best example of a shoe which falls into this third broad category is U.S. Pat. No. 4,372,058 to Stubblefield, which teaches an outsole in which the periphery of the heel of the outsole maintains the remaining portion of the heel of the outsole in a spaced apart relationship to the ground. This configuration is known as a cantilever outsole. The cantilever configuration helps to redirect vertical forces while increasing energy return to a runner.

In the Stubblefield patent referred to above, an outsole is provided which has a plurality of lugs or levers which extend from the periphery of the bottom of the outsole. These lugs are designed to redirect vertical forces on the outsole so that the forces have at least a horizontal component thereby reducing the stresses on a runner. The Stubblefield patent provides a shoe which provides both cushioning and stability.

One object of the present invention is to improve the design of the Stubblefield shoe by providing even better stability and rebound characteristics and to provide a shoe which utilizes a minimum amount of the heavy outsole material found in conventional outsoles.

SUMMARY OF THE INVENTION

To achieve the foregoing and other objects, and in accordance with the purposes of the present invention, as embodied and broadly described herein, the athletic shoe of the present invention includes the use of a conventional upper and a sole attached to the upper. The sole includes an outsole having a central heel portion and a plurality of periphery lugs. These lugs are effective to contact the ground and to maintain the central heel portion in a spaced apart relationship to the ground. The athletic shoe of the present invention may also include a midsole and an insert member. This insert member is made of a material which may have a hardness greater than the midsole and positioned to cooperate with the outsole by coacting with the outsole.

In one aspect of the invention, the central heel portion of the outsole defines an opening which may expose the insert member. Another aspect of the invention is for the periphery lugs to extend downwardly and outwardly from the central heel portion and for insert extensions to also extend downwardly and outwardly.

In yet another aspect of the invention, the insert has a substantially planar body portion and has insert extensions which extend downward from the body portion. The insert member may be made of a number of materials such as a polymeric material such as Hytrel, Delrin, or Rynite, all products made by E.I. Dupont de Nemours & Co., Inc. The insert member may also be made of a combination of these materials, for example, a combination of Rynite and Hytrel. Similarly, the polymeric material may be glass-reinforced and may have a number of openings for reducing the weight of the insert or built up portions for increasing the rigidity and strength of the insert member. In addition, other high memory, resilient material may be used to practice the invention.

Yet another aspect of the invention is a method for fabricating a sole. This method includes the steps of preloading an insert member and encapsulating the insert member in a midsole material whereby the midsole material retains the insert member in a preloaded condition. In using this method, the insert member may have a body portion and a plurality of extension members which extend downwardly and outwardly from said body portion. To preload the insert member, the insert extensions may be forced into a mold which retains the insert member in a preloaded position. Midsole material may then be blown into the mold and set to retain the insert member in the loaded position. This method allows a midsole to store potential energy.

In one aspect of this method, the insert member has a hardness which is greater than the hardness of the midsole material. The insert in this method may be made of a polymeric material such as a polyester elastomer such as Hytrel. In addition, the material may be a polyamide such as Zytel or the like.

One advantage of the invention is that the insert member provides improved energy return and improves the memory characteristics of the sole.

Yet another advantage of the invention is that it increases the life of a shoe because it will not break down and slows fatigue. If a midsole is used in conjunction with the insert, it can slow fatigue of the midsole material.

Yet another advantage of the invention is that it provides a sole which has improved load characteristics and strength.

Yet another advantage of the invention is that it allows the midsole to be tuned during manufacture for optimum energy return for its intended end use.

Yet another advantage of the invention is that it allows a midsole to recover to a relaxed state between strides of a user.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION OF THE PREFERRED EMBODIMENTS

Figure 1:
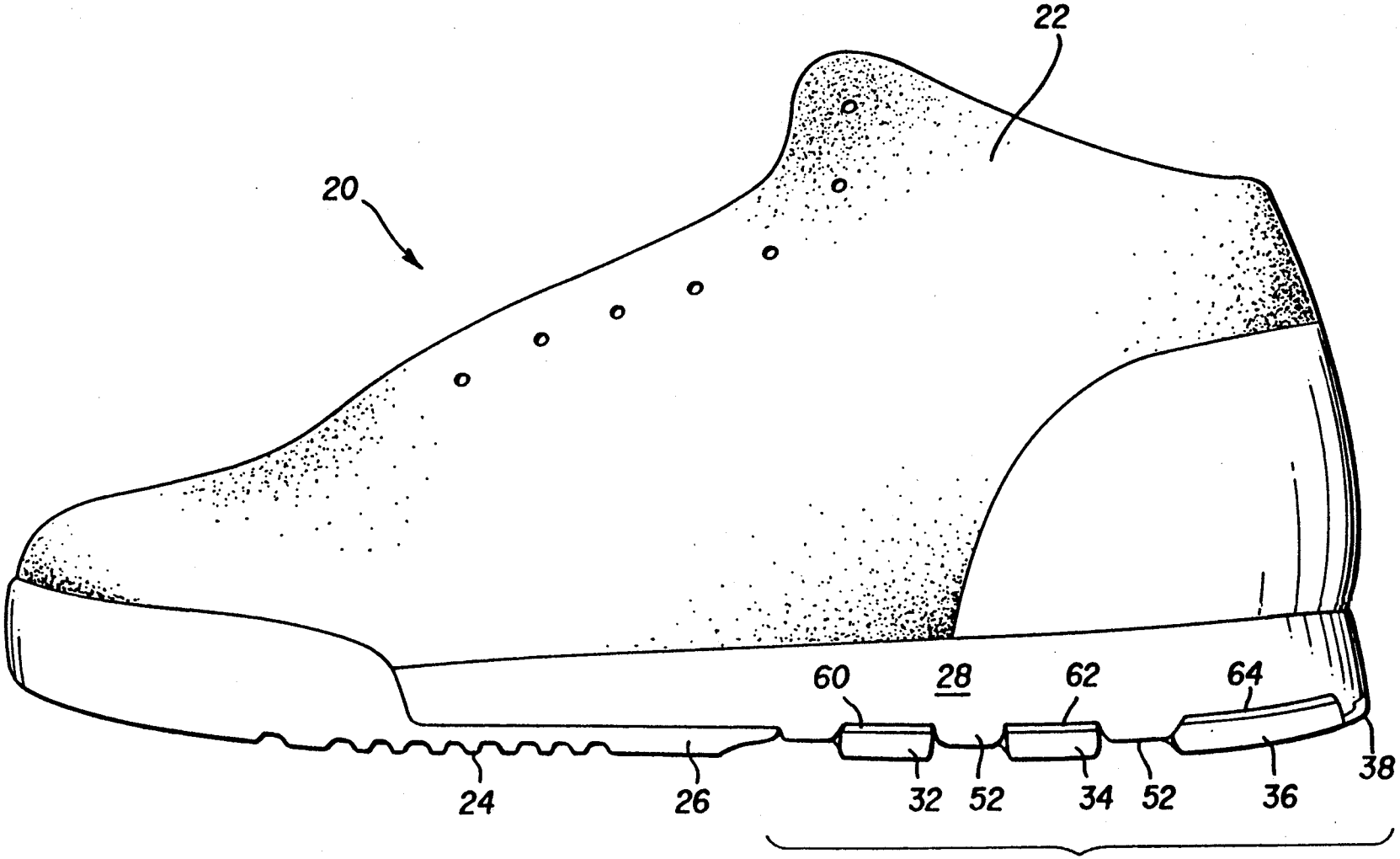
FIG. 1 is an elevational view of the lateral side of a shoe embodying the present invention.
Figure 2:
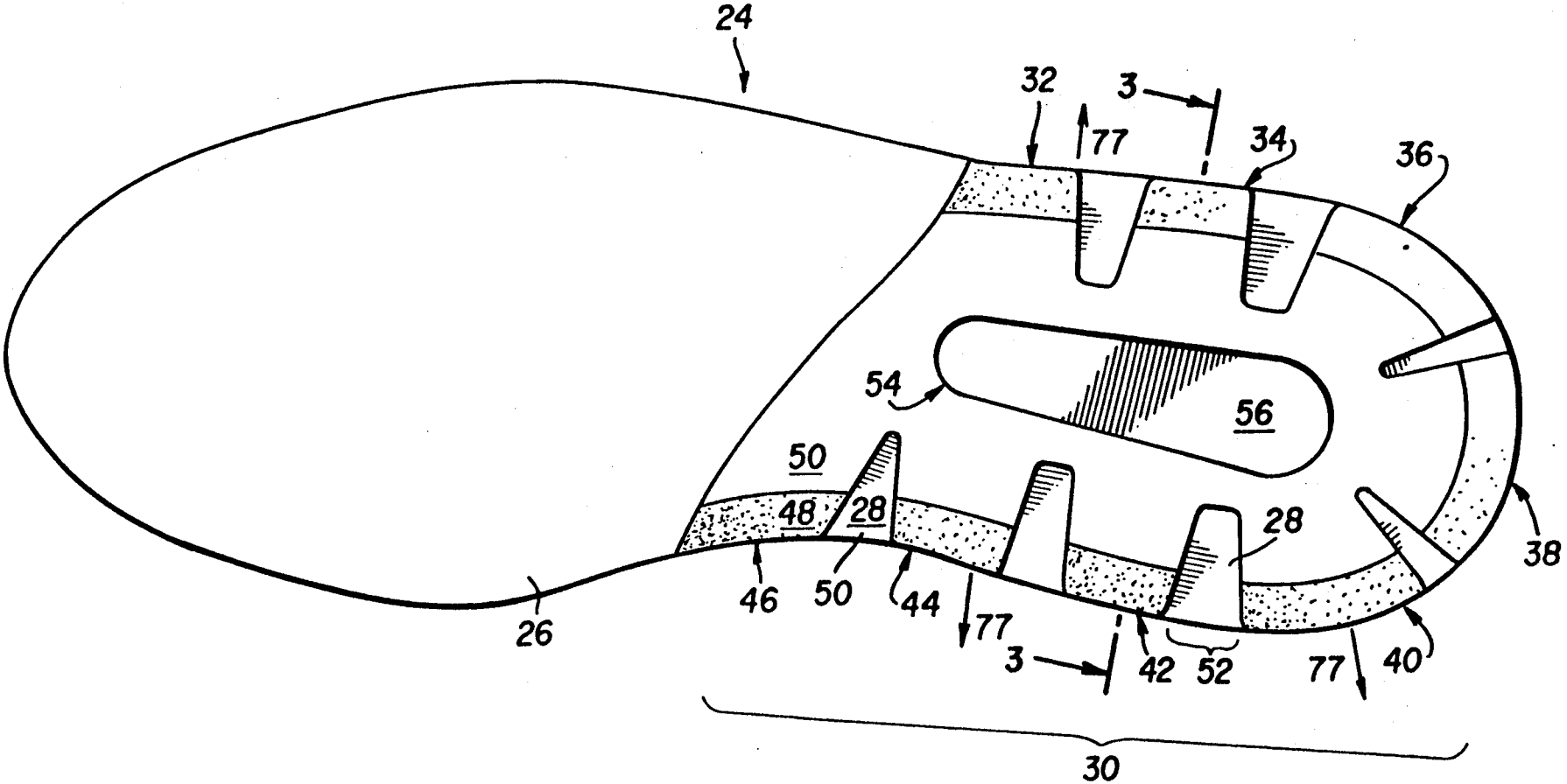
FIG. 2 is a bottom view of the shoe shown in FIG. 1.
Figure 3A:
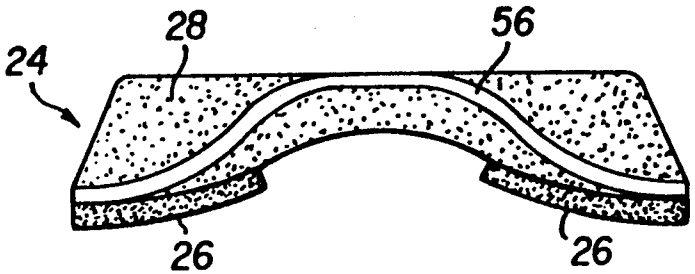
FIG. 3A is a cross-section of another embodiment of the invention.
Figure 3:
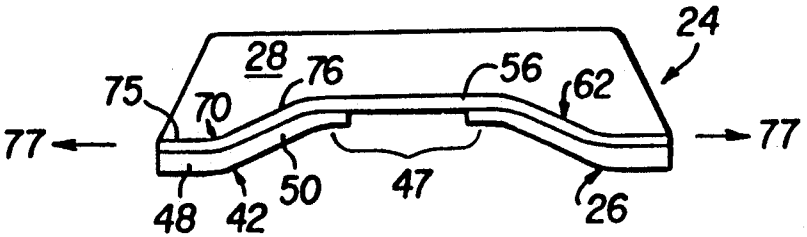
FIG. 3 is a schematic representation of a cross-section cut along line 3—3 of FIG. 2.

Referring first to FIGS. 1-3, there is shown an athletic shoe which has improved energy return, memory characteristics and increased durability. A shoe, designated generally as 20, is made of a number of component parts which include an upper 22 and a sole 24. In the present invention, any conventional upper 22 may be used to practice the invention. Although an athletic shoe is shown in FIG. 1, and the specification is directed in particular to athletic shoes, it is contemplated that the invention may be used on a number of different categories of shoes or boots, for example, hiking boots, casual shoes and the like. The upper 22 is attached to a sole 24 in any conventional manner. The sole 24 is made up of an outsole 26 made of a material which is wear resistant and provides traction. As with conventional outsoles, it may be made of any abrasive resistant material such as rubber or the like. A midsole 28 is disposed generally between outsole 26 and upper 22. Midsole 28 may take on a number of forms and modifications as an artisan in the field of shoes will readily recognize. For example, midsole 28 may be made from a single material or several different materials, each having different characteristics such as density and rebound characteristics. The main purpose of midsole 28 is for cushioning and it may be made of a number of different materials, for example, ethyl vinyl acetate, polyurethane, or a combination thereof. In addition, midsole 28 may include a heel wedge.

The heel region of the shoe, designated as 30, is that portion of the shoe which underlies the heel of a wearer. While heel region 30 of shoe 20 has no precise borders, it generally may be considered as that half of the shoe away from the toe of a wearer. Although the term "heel region" is used throughout this specification, it should be noted that this region may extend into what is traditionally known as the arch area of the shoe and may in fact extend well beyond what might traditionally be characterized as the heel.

In heel region 30 of outsole 26, there are a plurality of lugs 32–46 (FIG. 2) which extend downwardly from a central heel portion 47 (FIG. 3) of the heel region 30. Lugs 32–46 are preferably arranged in a cantilever configuration and thus maintain the central heel portion 47 at a spaced relationship to the ground. This is best seen in FIG. 3 which illustrates that the central heel portion 47 is prevented from contacting the ground. Sole 24 is shown in an unloaded condition in this figure. In a preferred embodiment of the invention, lugs 32–46 are designed to flare outwardly to change the direction of forces which are disposed substantially perpendicular to the heel. To highlight the importance of redirecting forces, a runner may generate, upon foot strike, forces which are up to three times the runner's body weight. If these extreme forces are not dissipated, a runner may face serious and debilitating injuries. Typically, forces generated during running or other activities are not precisely perpendicular to the heel. During heel strike, for example, the lateral side of a shoe makes contact with the ground first and the shoe then rotates before toe-off. Different sports generate varying forces at various angles to a shoe. The above-described cantilever outsole serves to redirect forces irrespective of the precise angle of incidence upon a shoe. This outsole concept is more fully disclosed in U.S. Pat. No. 4,372,058 to Stubblefield, the disclosure of which is expressly incorporated herein by reference.

Each of the lugs 32–46 on outsole 26 have a land 48 for contacting the ground. These lands 48 are configured to make contact with the ground and preferably have a roughened surface to provide traction. Lands 48 may consist of a flat surface as shown in FIG. 2 and 3 or may be a point or small area. Each of the lugs 32–46 may have an angled area 50 which leads from the central heel portion 47 to the lands 48. It is preferred that this angled area 50 is a gradual angle as shown in FIG. 3, but it may also be vertical. In the embodiment of the invention shown in FIG. 2, wedge-shaped portions 28' of midsole 28 extend between lugs 32–46. The spacing 52 between adjacent lugs enables lugs 32–46 to act more independently of each other.

Although the lugs in the accompanying drawings are shown to be separate and distinct members, it is contemplated that the heel portion of the outsole may form a concavity, without individual lugs. In other words, instead of distinct, individual lugs such as the eight lugs 32–46 shown in FIG. 2, there may be a single "lug" which extends from the medial side of the shoe, around the heel, to the lateral side of the heel.

Outsole 26 may include a cut-out 54 in substantially the central heel portion 47 of the outsole. Cut-out 54 is provided primarily to reduce the weight of outsole 24 by eliminating material which is not necessary. Because central heel portion 47 never makes contact with the ground, there is no need for the abrasive resistant material of the outsole to be present in that area. By having a cut-out 54, the overall weight of the shoe is reduced without reducing stability. In addition, the outsole may extend up along the side of the midsole for, e.g. basketball shoes and the like.

The present invention comprises a configuration of components to improve the rebound characteristics of a sole and to provide improved stability. To achieve this, an insert member 56 is generally used in conjunction with the above-mentioned shoe components to provide additional stability and memory characteristics to the sole of the shoe. The insert member 56 helps to increase the life of a shoe. The insert member while having a long life itself also helps prevent a midsole material from breakdown due to fatigue. A long life and decreased break down due to fatigue is possible because it is the insert which absorbs and transmits most of the generated forces. In addition, the insert member allows a midsole to recover to a relaxed state between strides. In running, for example, a runner while jogging may take one hundred strides per minute. While most midsoles cannot recover fully between strides, the present invention will enable a midsole to make such a recovery.

The insert member 56, which may be positioned in a number of different locations as will be amplified below, enhances the overall stability of sole 24 and works in conjunction with the other component parts of sole 24. Generally, insert member 56 is positioned either sandwiched between the outsole 26 and the midsole 28, encapsulated within the midsole 28 or encapsulated within outsole 26.

In FIG. 3A, an alternative embodiment of the invention is shown. This embodiment is a similar view as FIG. 3, but shows an alternative position of insert member 56. In this embodiment, the insert member 56 makes contact with both the outsole 26 and a lasting board which is typically placed above the midsole in a conventional athletic shoe. This configuration provides for an efficient use of the invention, since there is no midsole material, e.g., polyurethane, above the insert member 56 along the longitudinal centerline of the heel region of the shoe.

Figure 3B:
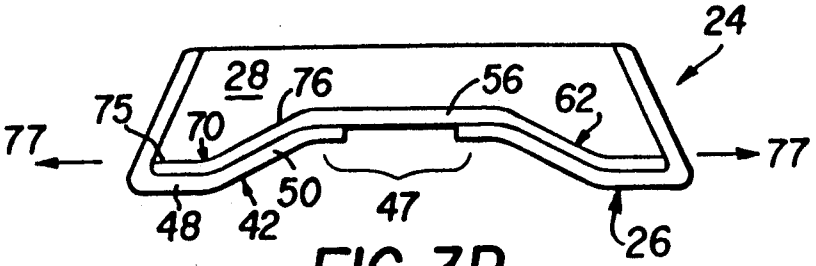
FIG. 3B is a cross-section of another embodiment of the invention.

In FIG. 3B, yet another embodiment of the invention is depicted. In this cross-sectional view, it is seen that outsole 26 extends up the side of midsole 28. The outsole may extend upward onto the midsole around the entire heel of the shoe, if desired.

Figure 4:
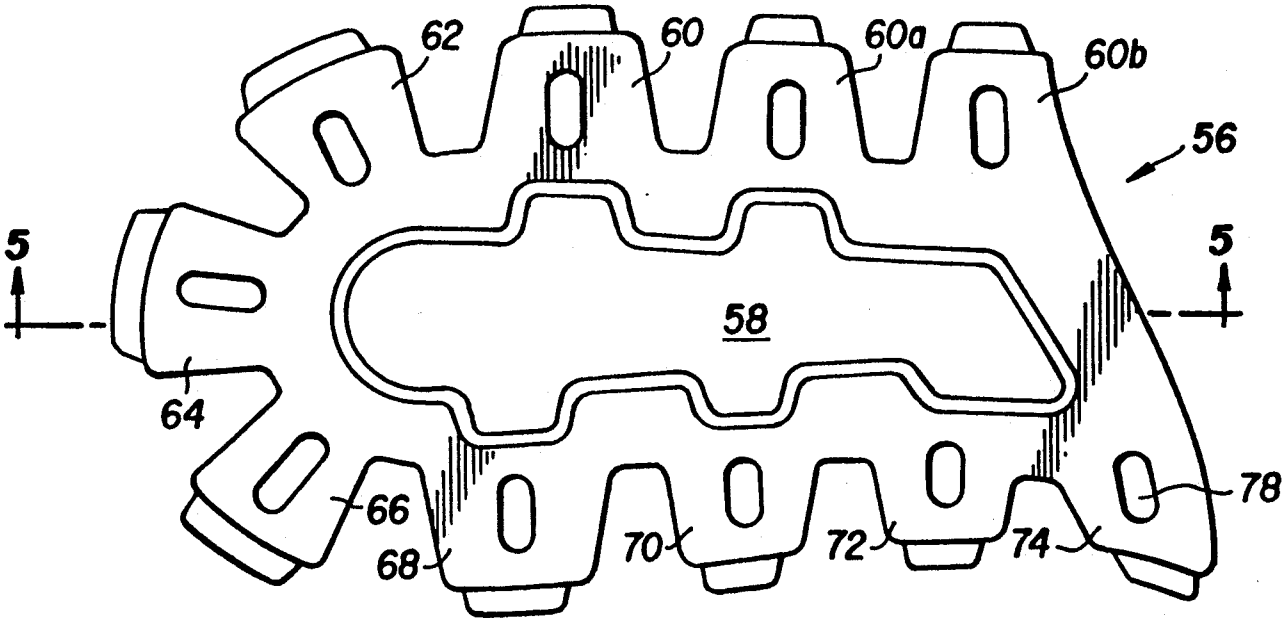
FIG. 4 is a top plan view of one insert member of the present invention.
Figure 5:
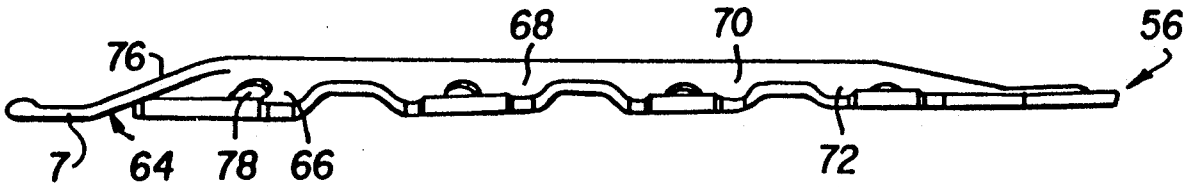
FIG. 5 is a side view of the insert member shown in FIG. 4.

In a preferred embodiment of the invention as illustrated in FIGS. 4 and 5, insert member 56 has a central body portion 58 and a plurality of insert extensions 60–72 which extend outwardly and downwardly from central body portion 58. In general, insert extensions 60–72 have a flat section 75 at the distal ends thereof (seen best in FIGS. 3 and 5). It should be noted that the insert member 56 illustrated in FIG. 4 utilizes ten insert extensions, while the insert member of FIGS. 1–3 utilizes eight insert extensions. For convenience, the additional two insert extensions of member 56 of FIG. 4 have been designated **60*a* and 60*b***. In operation, the number of insert extensions may be varied as needed to most effectively operate in conjunction with the other component parts of the sole.

The rebound characteristics of the insert member 56 can be controlled by varying a number of different parameters. For example, some or all of the insert extensions 60–72 may define openings 78 or may be built up. Openings 78 increase flexibility of an individual insert extension and decrease the weight of the insert 56.

A number of different conventional materials are available for making insert member 56. Examples of possible materials include: Zytel, a polyamide which may be glass reinforced with, for example, 18% glass;

Delrin; Rynite; Hytrel; or a combination of the above materials such as a Hytrel/Rynite mixture. Zytel, Delrin, Rynite and Hytrel are all manufactured by DuPont. Hytrel is a semicrystalline and fully polymerized, high molecular weight, chemically stable, thermoplastic polyester elastomer composed of alternate amorphous and crystalline chains.

The above materials are intended to be illustrative of some of the possible materials for use in insert member 56. This list is not exhaustive or comprehensive and it should be understood that many different materials may be used to practice the invention. In general, the common denominator of the materials which may be utilized to embody the invention is that the material must have good memory characteristics, that is, the material must tend to return to its original shape after deformation. In addition, the material must be durable and must not be brittle; otherwise, it may not be able to withstand the constant cycling of the material without cracking or breaking. The material used for making the insert member may be harder than either the midsole material or the outsole, but need not be harder. Since the hardness of the insert member as well as its thickness may be modified to achieve a desired response, there may be circumstances whereby a relatively soft insert member 56 is utilized. The invention can be modified and tuned for the different requirements of different sports.

Insert member 56 is preferably disposed in a location which will allow the insert member to cooperate with the other shoe components. This location is not limited to being next to or juxtaposed to the outsole. The insert member 56 may cooperate with the outsole if it is encapsulated within the midsole, sandwiched between the midsole and the outsole, or encapsulated within the outsole. The insert member may also be partially encapsulated within the midsole. In the embodiment of the invention shown in FIGS. 1-3, insert member 56 lies between outsole 26 and midsole 28. It may be attached to the outsole and midsole in any conventional manner. For example, the insert member may be cemented to the outsole. If insert member 56 is disposed directly above outsole 26, the central portion of the insert member may be exposed through cut-out 54 in outsole 26 as shown in FIG. 2. The insert extensions 60-72 positionally correspond to lugs 32-46 in outsole 26 and cooperate therewith to provide increased stability and rebound characteristics for sole 24. The insert extensions 60-72 have a flat section 75 which positionally correspond to lands 48 in the outsole. In operation, insert member 56 and insert extensions 60-72 cooperate with lugs 32-46 and move outward as forces impinge on the sole. In this specification, the term "outward" is used to mean that direction which is away from the central portion of the shoe in the plane defined generally by the outsole. This direction is locally the direction perpendicular to a line which is tangent to the perimeter of the outsole. In FIGS. 2 and 3, "outward" is the direction shown by arrows 77. Conversely, "inward" is the direction toward the central portion of the shoe. Generally speaking, a curved portion 76 connects the flat portion 75 of insert extensions 60-72 to central body 58 of insert member 56. Member 56 may be tailored to specific needs by adding additional openings 78 or by building up sections of the extensions as desired. Additional apertures will increase the flexibility of the insert extension having the apertures. Conversely, building up an insert extension will make the insert extension more rigid. In effect, the insert member may be "tuned" by adding apertures to those extension members where additional flexibility is desired and building up those extension members where it is desirable for the extension member to be more rigid. For example, it may be desirable to have a specific area of the sole less compressible than the remaining areas of the sole. This can be accomplished by building up those extension members in the area for which less compression is desired or by adding apertures to the extension members in the area for which more compression is desired or a combination of these two approaches.

Figure 6:
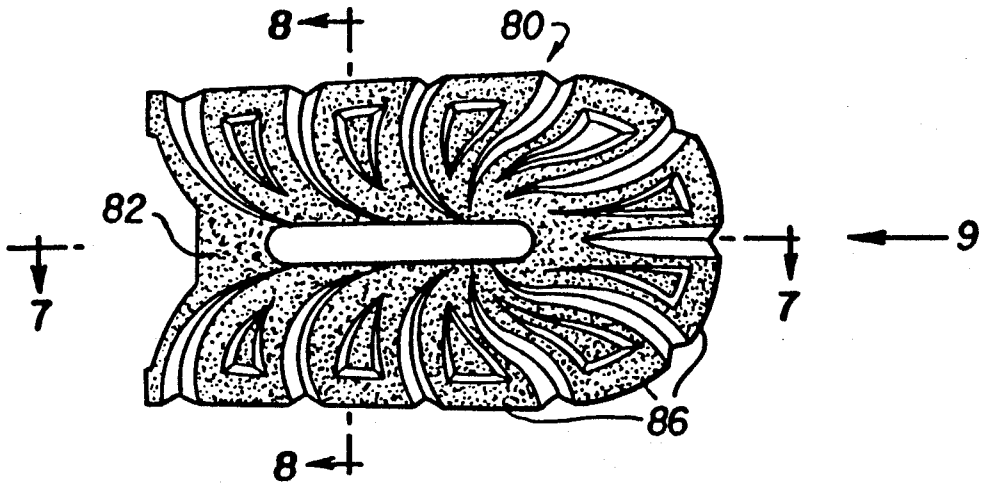
FIG. 6 is the bottom of a heel showing another embodiment of the invention.
Figure 8:
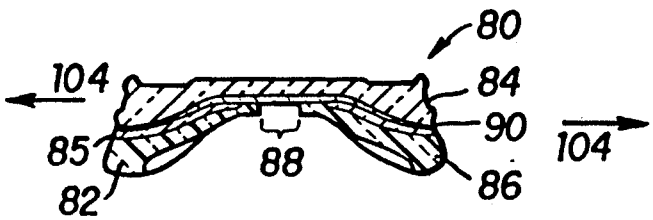
FIG. 8 is a cross-section of FIG. 6 cut along lines 8—8.
Figure 7:
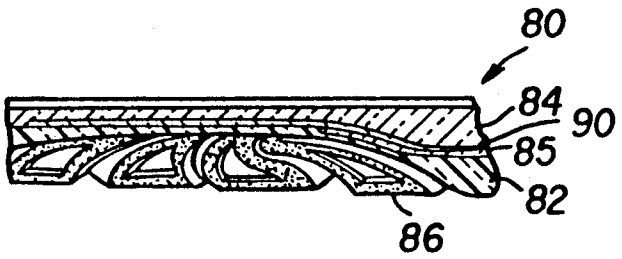
FIG. 7 is a cross-sectional view of FIG. 6 cut along lines 7—7.

FIGS. 6-17 illustrate yet another embodiment of the invention. FIGS. 6-8 illustrate a part of a sole 80 which has an outsole 82 and a midsole 84. As with the previously described embodiment of the invention, outsole 82 has a plurality of lugs 86 which are shaped to maintain the remaining, central portions of the sole 80 at a spaced relationship to the ground. As with other embodiments of the invention, there may be a cutout 88 in the outsole. This cutout reduces the weight of the shoe by eliminating the outsole in an area it is not necessary. FIGS. 7-8 illustrates an insert member 90 encapsulated within midsole 84. A portion 85 of midsole 84 lies below insert member 90. By encapsulating insert member 90 within midsole 84, it is possible to improve the rebound characteristics of the sole 80 by prestressing insert member 90 prior to encapsulation. It should be noted, however, that prestressing of the insert member is not a requirement to practice the invention. To do so, insert member 90 is first placed in a mold, the perimeter of which is smaller at least in part than the perimeter of the pre-stressed insert member 90. By doing so, insert member 90 exerts a force against the mold and is biased in an outward direction. In FIG. 8, outward is the direction depicted by arrows 104.

After insert member 90 has been pre-stressed and placed in a mold, midsole material such as polyurethane (PU) is used to encapsulate insert member 90. This may be done by injection molding, for example. By selecting the proper materials, the midsole maintains the insert in a loaded or stressed configuration, and thus the midsole has potential energy stored within it.

Figure 9:
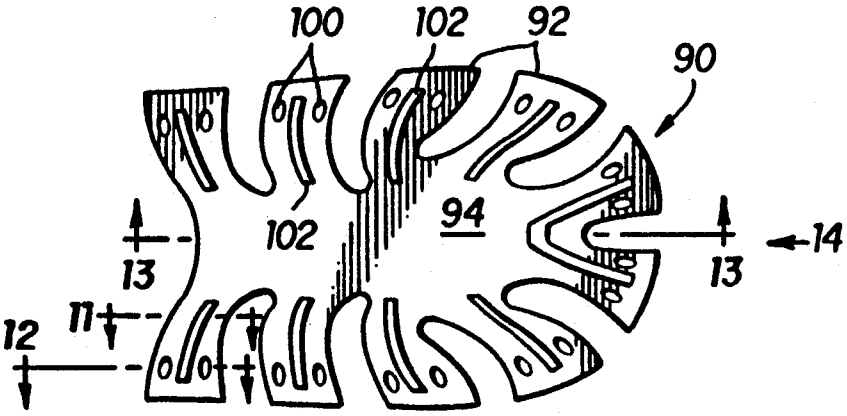
FIG. 9 is a top view of the insert used in the outsole shown in FIG. 6.
Figure 10:
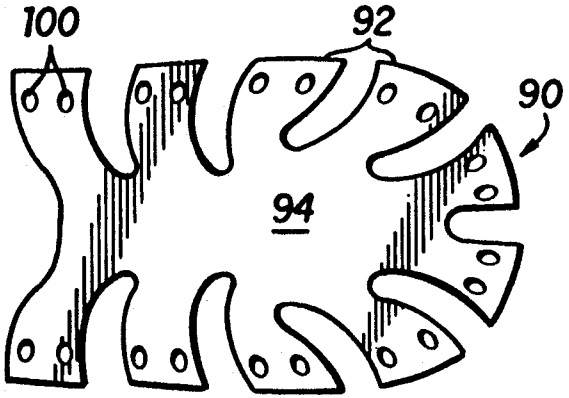
FIG. 10 is a bottom view of the insert shown in FIG. 9.

One embodiment of insert member 90 per se is illustrated in FIGS. 9-15. FIG. 9 is a top view of insert member 90 and FIG. 10 is a bottom view. Insert member 90 has insert extensions 92 which extend outwardly from a central body portion 94. These insert extensions 92 cooperate with lugs 86 of outsole 82 so that when a force impinges on the sole, both lugs 86 and insert extensions 92 will move in an outward direction and insert extension members 92, in cooperation with the other components of the sole, will act as a spring to return the sole to its original shape. A shortened recovery time or shortened midsole cycle time is particularly important in such activities as jogging and basketball. This serves to return energy to the user without having the "mushy" feeling associated with fluid filled shoes.

Figure 11:
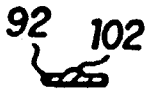
FIG. 11 is a view of FIG. 9 cut along line 11—11.

It can be seen from FIG. 11 that insert extensions 92 may have a built up section 102 which extends along the surface of insert extensions 92. Built up section 102 may take on a number of different forms but is used generally to tailor the response of the midsole. Built up section 102 gives the insert extensions more strength and less flexibility.

Figure 12:
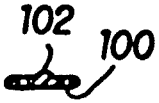
FIG. 12 is a view of FIG. 9 cut along lines 12—12.

As with built up section >102, insert extensions 92 may define holes or apertures 100 as shown in FIG. 12. Holes 100 may be used as needed to tailor the insert 90 to provide a desired response. Built up section 102 and apertures 100 may be used as needed, either alone in an insert member or together.

Figure 13:
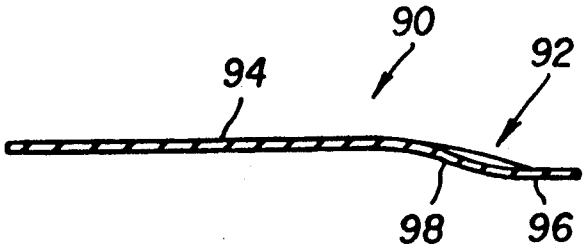
FIG. 13 is a view of FIG. 11 cut along lines 13—13.
Figure 14:
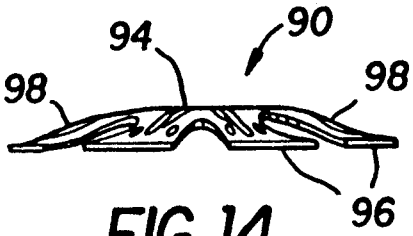
FIG. 14 is a side view of FIG. 9 looking in the direction of arrow 14.
Figure 15:
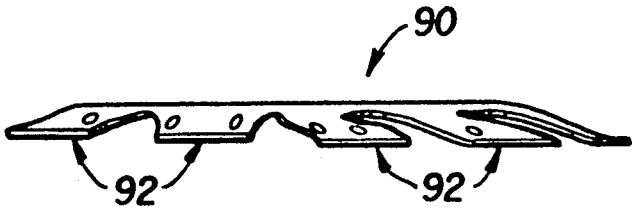
FIG. 15 is a side of the insert shown in FIG. 9.

As shown in FIGS. 13–15, insert extensions 92 may have a flat portion 96 which positionally corresponds generally to that portion of the outsole 82 which contacts the ground. A curved portion 98 connects flat portion 96 to central portion 94.

Figure 16:
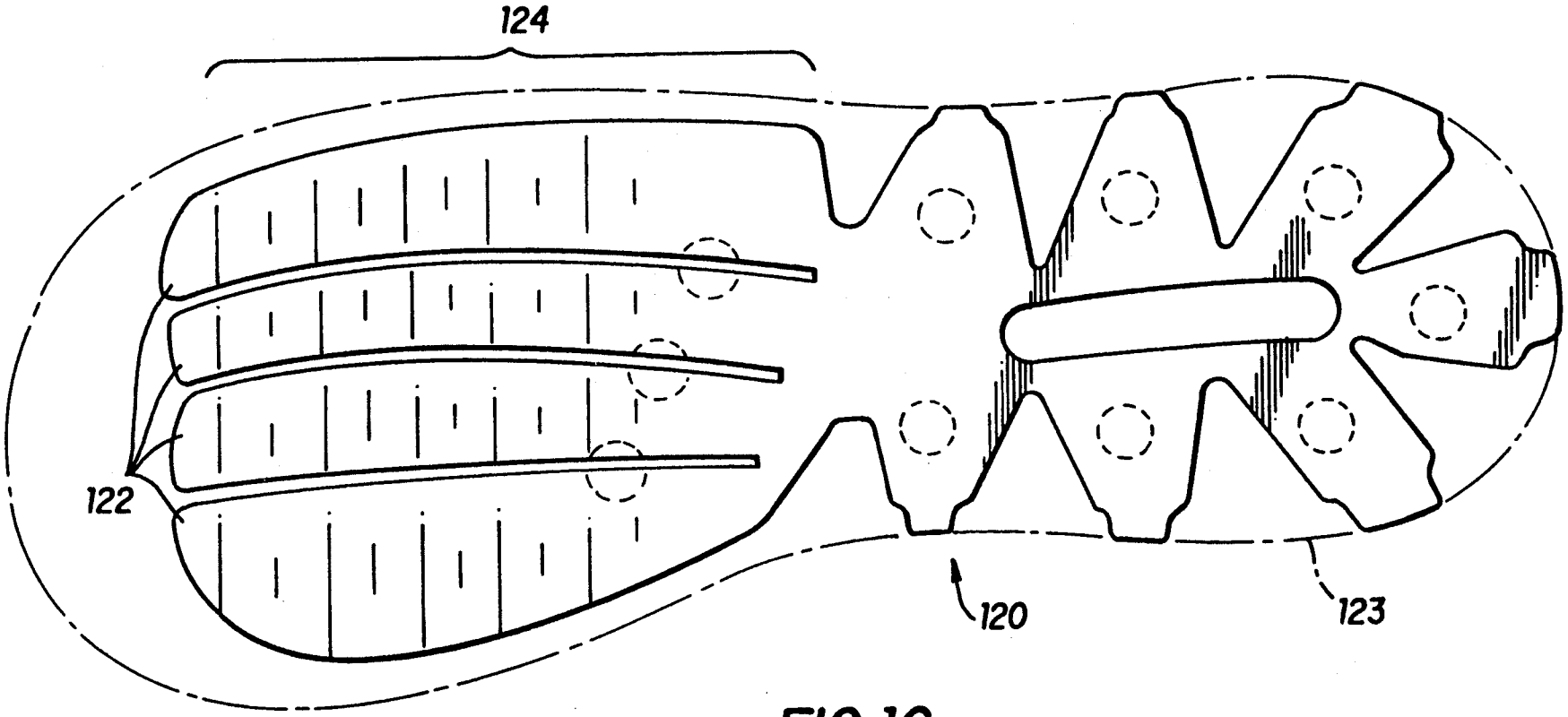
FIG. 16 is yet another embodiment of the insert of the present invention.
Figure 17:
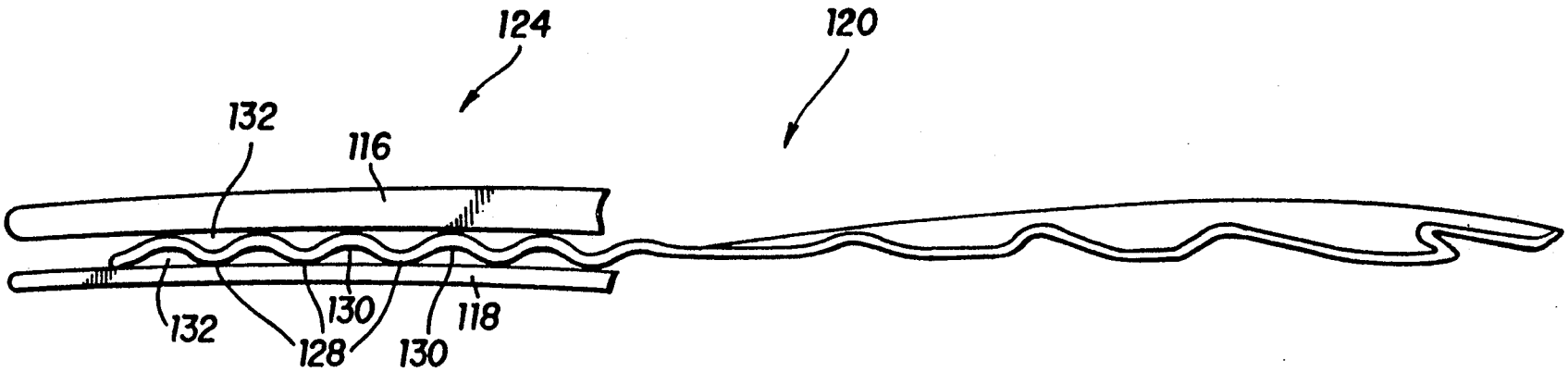
FIG. 17 is a side view schematic of the insert member of FIG. 20 in operation with other components.
Figure 18:
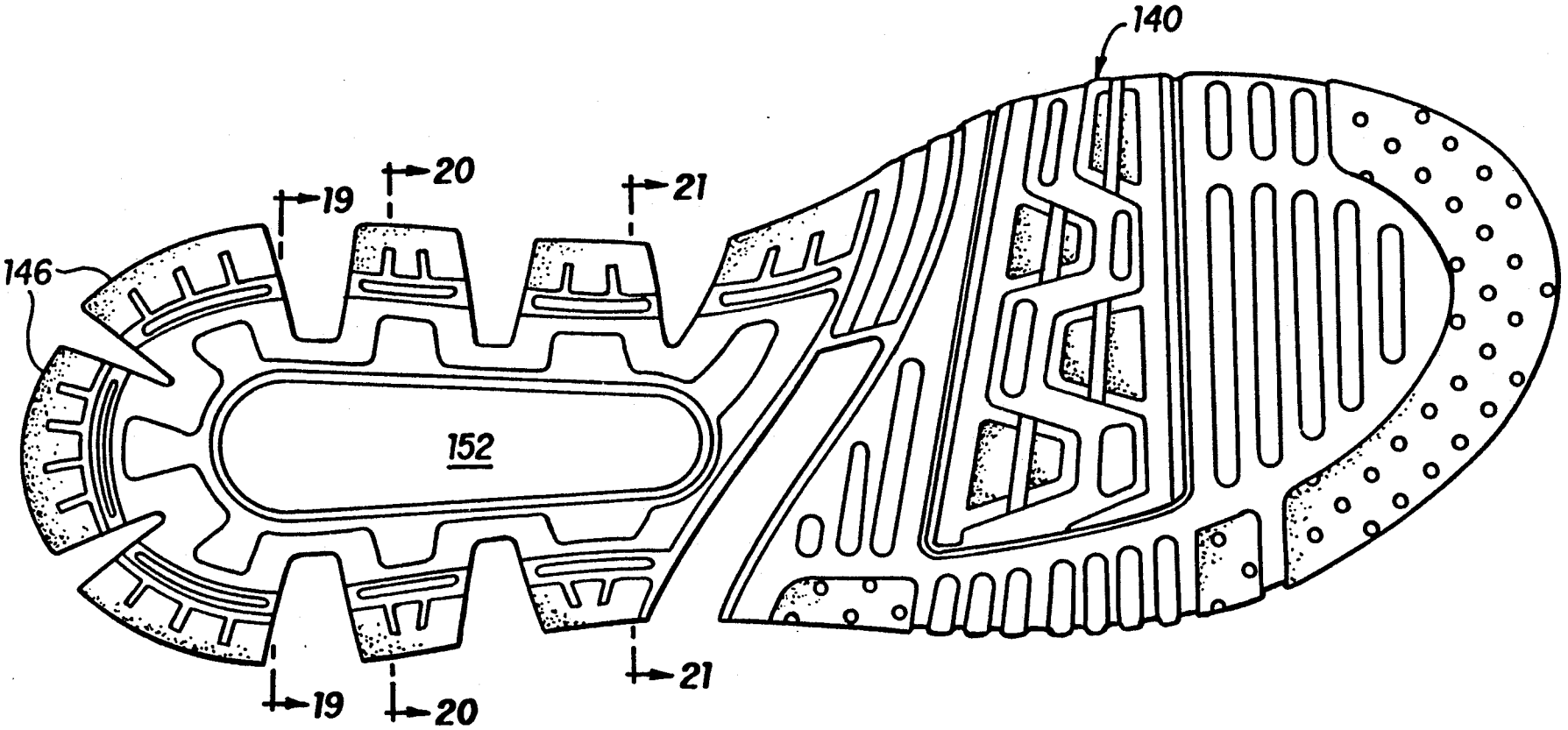
FIG. 18 is a bottom view of an outsole used for practicing the present invention.

Referring now to FIGS. 16 and 17, yet another embodiment of the invention is shown. FIG. 16 shows an insert member 120 having an extending portion 124, the distal end of which extends into the forefoot region of a shoe when positioned within the sole of a shoe. The outline of a shoe 123 is shown in FIG. 18 to help illustrate one possible placement of insert member 120. The extending portion 124 may be formed from a single piece of material such as those materials previously described for making the insert member and the insert member 120 and extending portion 124 are generally made from a single monolithic piece of material. It is understood, however, that it is possible to form the extending portion 124 from separate and distinct pieces of material.

The extending portion 124 may be formed by a plurality of fingers 122 which extend generally from the remaining portion of insert member 120 toward the toe region of shoe 123.

In a preferred embodiment, extending portion 124 is made to have an undulating or sinusoidal shape in cross section (FIG. 17). The undulations have peaks 128 which make contact with outsole 118 and spaced by valleys 130. The spaces 132 between midsole 116 and insert member 120, and between outsole 118 and insert member 120, are filled with air at ambient pressure.

In operation, the extending portion 124 of insert member 120 acts as a spring to return energy to the user. This occurs because forces acting perpendicular to sole 118 deflect the extending portion 124 and tend to decrease the size of the peaks 128 and valleys 130 when the load is placed on the extending portion 124. Because the materials used to form extending portion 124 have good memory characteristics, it tends to return to its original, unloaded shape. If the distal end of extending portion 124 is not attached to either the midsole or outsole, the extending portion 124 will increase in overall length upon loading. This occurs because the decreasing of the peaks 128 and valleys 130 of the undulations tend to force extending portion 124 in the direction away from the remaining portion of insert member 120.

Extending portion 124 is a feature which increases overall cushioning of the sole but does not otherwise affect the operation of the remaining portion of insert member 120. In other respects, insert member 120 shown in FIGS. 18 and 19 operates substantially the same as the insert member shown in FIG. 4.

Figure 20:
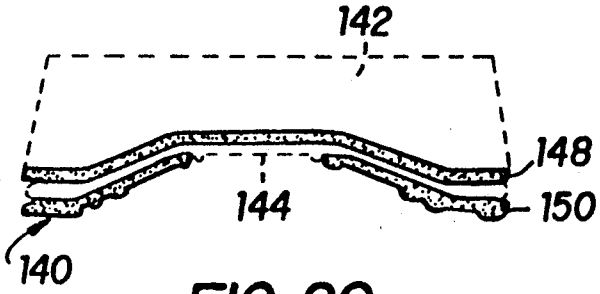
FIG. 20 is a view of FIG. 18 cut along line 20—20.
Figure 19:
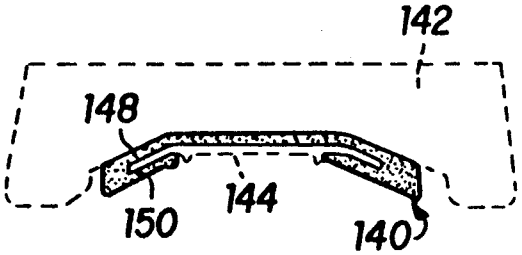
FIG. 19 is a view of FIG. 18 cut along line 19—19.
Figure 21:
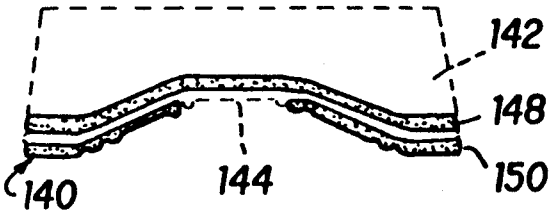
FIG. 21 is a view of FIG. 18 cut along line 21—21.

In the embodiment of the invention depicted in FIGS. 18–21, an insert member is substantially encapsulated by outsole material. These figures depict an outsole 140 which has a plurality of lugs 146. The outsole 140 is attached to a midsole 142 (shown in phantom). These lugs 146 work in substantially the same manner as those embodiments of the invention previously described. The outsole 140 includes an upper portion 148 and a lower portion 150. Between the upper and lower portions 148 and 150, respectively, is an insert member 144 (shown in phantom). This insert member 144 operates in substantially the same manner in this embodiment as it does in the embodiments of the invention previously described. As seen in FIG. 20 and 21, outsole 140 may define an opening 152. The upper and lower portions may be interconnected to wrap around the insert as shown in FIG. 19.

The foregoing description of the preferred embodiments of the invention have been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. A shoe comprising:

(a) an outsole, said outsole including a central heel portion and a plurality of lugs disposed around the periphery of said central heel portion, said lugs extending downwardly from said central heel portion such that said central heel portion is maintained in a spaced-apart relationship to the ground; and (b) an insert member at least partially encapsulated in said outsole, said insert member comprising a resilient material which tends to return to its original shape when deformed, said insert member having a central body portion corresponding to said central heel portion of said outsole and having a plurality of insert extensions, said insert extensions extending downwardly and outwardly from said central body portion so that said insert extensions are configured to redirect vertical forces applied to said shoe into substantially horizontal forces, said insert extensions configured to move outward as said vertical forces impinge on said outsole so that said insert member returns energy from said vertical forces to said outsole to enhance recovery of said outsole.

2. The shoe of claim 1, wherein said outsole defines a central opening, said insert member being partially visible through said central opening.

3. The shoe of claim 2, wherein said insert member includes a plurality of openings therein.

4. The shoe of any of claim 1–3, wherein said insert member comprises a polymeric material.

5. The shoe of claim 4, wherein said polymeric material is glass reinforced.

6. The shoe of claim 5, said shoe further comprising a midsole disposed within said shoe above said outsole.

7. A shoe comprising:

(a) an outsole, said outsole including a central heel portion and a plurality of lugs disposed around the periphery of said central heel portion, said lugs extending downwardly from said central heel portion such that said central heel portion is maintained in a spaced-apart relationship to the ground;

(b) a midsole disposed in said shoe above said outsole; and (c) an insert member at least partially encapsulated in said midsole, said insert member comprising a resilient material which tends to return to its original shape when deformed, said insert member having a central body portion corresponding to said central heel portion of said outsole and having a plurality of insert extensions, said insert extensions extending downwardly and outwardly from said central body portion so that said insert extensions are configured to redirect vertical forces applied to said shoe into substantially horizontal forces, said insert extensions configured to move outward as said vertical forces impinge on said midsole so that said insert member returns energy from said vertical forces to said midsole to enhance recovery of said midsole.

8. The shoe of claim 7, wherein said outsole defines a central opening, said insert member being partially visible through said central opening.

9. The shoe of claim 8, wherein said insert member includes a plurality of openings therein.

10. The shoe of any of claims 7–9, wherein said insert member comprises a polymeric material.

11. The shoe of claim 10, wherein said polymeric material is glass reinforced.

12. A shoe having an upper and a sole, said shoe comprising:

(a) an outsole, said outsole including a central heel portion and a plurality of lugs disposed around the periphery of said central heel portion, said lugs extending downwardly from said central heel portion such that said central heel portion is maintained in a spaced-apart relationship to the ground;

(b) a midsole disposed in said shoe above said outsole; and (c) an insert member disposed in said shoe between said outsole and said midsole, said insert member comprising a resilient material which tends to return to its original shape when deformed, said member having a central body portion corresponding to said central heel portion of said outsole and having a plurality of insert extensions, said insert extensions extending downwardly and outwardly from said central body portion so that said insert extensions are configured to redirect vertical forces applied to said shoe into substantially horizontal forces, said insert extensions configured to move outward as said vertical forces impinge on said outsole so that said insert member returns energy from said vertical forces to said outsole to enhance recovery of said outsole.

13. The shoe of claim 12, wherein said outsole defines a central opening, said insert member being partially visible through said central opening.

14. The shoe of claim 13, wherein said insert member includes a plurality of openings therein to reduce the weight thereof.

15. The shoe of any of claims 12–14, wherein said insert member comprises a polymeric material.

16. The shoe of claim 15, wherein said polymeric material is glass reinforced.

17. The shoe of claim 1 wherein said insert member is made from a single monolithic piece of material.

18. The shoe of claim 12 wherein said insert member is made from a single monolithic piece of material.

19. A shoe having a medial side and a lateral side, said shoe comprising:

(a) an outsole, said outsole including a central heel portion and a plurality of lugs disposed around the periphery of said central heel portion, said lugs extending downwardly from said central heel portion such that said central heel portion is maintained in a spaced-apart relationship to the ground; and (b) an insert member at least partially encapsulated in said outsole, said insert member comprising a resilient material which tends to return to its original shape when deformed, said insert member comprising a medial extension extending downwardly and outwardly toward said medial side of said shoe and a lateral extension extending downwardly and outwardly toward said lateral side of said shoe, so that said medial extension and said lateral extension are configured to redirect vertical forces applied to said shoe into substantially horizontal forces, said medial and lateral extensions configured to move outward as said vertical forces impinge on said outsole so that said insert member returns energy from said vertical forces to said outsole to enhance recovery of said outsole.

20. The shoe of claim 19 wherein said insert member is made from a single monolithic piece of material.

21. The shoe of claim 19 wherein said medial extension is larger than said lateral extension.

22. The shoe of claim 19 wherein the hardness of said medial extension is greater than the hardness of said lateral extension.

23. The shoe of claim 19 wherein said medial extension includes openings.

24. The shoe of claim 19 wherein said lateral extension includes openings.

25. A shoe having a medial side and a lateral side, said shoe comprising:

(a) an outsole, said outsole including a central heel portion and a plurality of lugs disposed around the periphery of said central heel portion, said lugs extending downwardly from said central heel portion such that said central heel portion is maintained in a spaced-apart relationship to the ground;

(b) a midsole disposed in said shoe above said outsole; and (c) an insert member disposed in said shoe between said outsole and said midsole, said insert member comprising a resilient material which tends to return to its original shape when deformed, said insert member comprising a medial extension extending downwardly and outwardly toward said medial side of said shoe and a lateral extension extending downwardly and outwardly toward said lateral side of said shoe, so that said medial extension and said lateral extension are configured to redirect vertical forces applied to said shoe into substantially horizontal forces, said medial and lateral extensions configured to move outward as aid vertical forces impinge on said outsole so that said insert member returns energy from said vertical forces to said outsole to enhance recovery of said outsole.

26. The shoe of claim 25 wherein said insert member is made from a single monolithic piece of material.

27. The shoe of claim 25 wherein said medial extension is larger than said lateral extension.

28. The shoe of claim 25 wherein the hardness of said medial extension is greater than the hardness of said lateral extension.

29. The shoe of claim 25 wherein said medial extension includes openings.

30. The shoe of claim 25 wherein said lateral extension includes openings.

* * * * *